US005280303A

United States Patent [19]

Maslanka

[11] Patent Number: 5,280,303

[45] Date of Patent: Jan. 18, 1994

[54] HIGH PRECISION DONOR WEB POSITIONING APPARATUS AND METHOD FOR A THERMAL PRINTER

[75] Inventor: Daniel C. Maslanka, Rochester, N.Y.

[73] Assignee: Eastman Kodak Company, Rochester, N.Y.

[21] Appl. No.: 905,700

[22] Filed: Jun. 29, 1992

[51] Int. Cl.[5] ..... B41J 2/32

[52] U.S. Cl. ..... 346/76 PH; 400/235; 400/235.1; 400/233; 400/240.3; 400/240.4

[58] Field of Search ..... 346/76; 400/120, 235, 400/235.1, 233, 240.3, 240.4

[56] References Cited

U.S. PATENT DOCUMENTS

| | | | |
|---|---|---|---|
| 4,505,603 | 3/1985 | Yana | 400/120 |
| 4,614,950 | 9/1986 | Ito | 346/76 PH |
| 4,893,951 | 1/1990 | Iwatani et al. | 400/240.3 |
| 5,017,943 | 5/1991 | Ogita et al. | 346/76 PH |
| 5,021,804 | 6/1991 | Nozawa et al. | 346/76 PH |
| 5,117,241 | 5/1992 | Stephenson | 346/76 PH |

FOREIGN PATENT DOCUMENTS

| | | | |
|---|---|---|---|
| 0130180 | 6/1991 | Japan | 400/235 |

*Primary Examiner*—Benjamin R. Fuller
*Assistant Examiner*—Huan Tran
*Attorney, Agent, or Firm*—Milton S. Sales

[57] ABSTRACT

A thermal printer has a donor web positioning system that uses a single sensor in conjunction with a capstan roller. The roller is driven by a stepper motor to precisely meter the donor web. The roller is positioned between the print drum and the take-up spool and drivingly engages the donor web and controllably advances the donor web towards the take-up spool at a known rate as the web is paid out of the print zone. The single sensor is positioned between the print drum and the supply spool to detect the start of the plurality of frames of dye, as the donor web advances. Each individual frame is then positioned properly by causing the capstan drive motor to advance a known, pre-programmed number of steps to place the beginning of each color frame at the heater line of the thermal head.

3 Claims, 1 Drawing Sheet

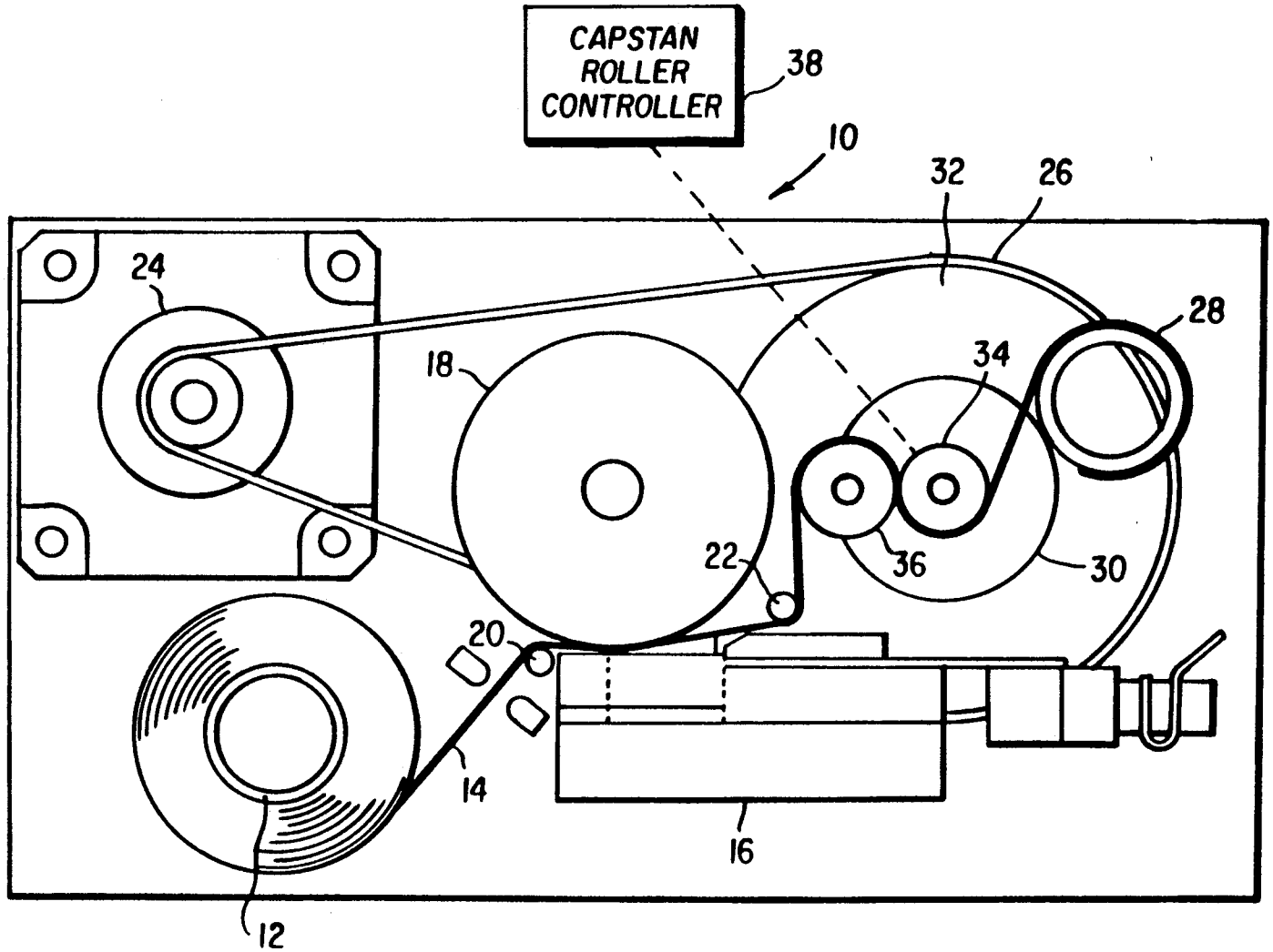
CAPSTAN
ROLLER
CONTROLLER
38
10
32
26
28
34
30
36
22
16
18
20
14
24
12

HIGH PRECISION DONOR WEB POSITIONING APPARATUS AND METHOD FOR A THERMAL PRINTER

TECHNICAL FIELD

Cross-Reference to Related Applications

This application is related to commonly assigned U.S. patent application Ser. No. 905,701, filed Jun. 29, 1992 by Daniel C. Maslanka and entitled "An Apparatus and Method for Thermal Printing Wherein Donor Slack is Controlled by a Capstan Roller".

This invention relates generally to an apparatus and method for advancing a donor web in a thermal printer, and, more particularly, to an apparatus and method for advancing the donor web with high precision for precise color registration and minimal donor waste.

BACKGROUND OF THE INVENTION

In a thermal printing process, a dye bearing donor web is brought into contact with a dye receiving print media at a print zone. Thermal printing is effected by contacting the donor web with a print head that spans the donor web in a direction transverse to the direction of web travel. To maintain intimate contact between the donor web and receiver during the printing operation, the donor web and print media are partially wrapped around the surface of a print drum. The print drum is commonly driven by a precision stepper motor so that the spacing between adjacent image lines can be precisely controlled. Print quality is influenced considerably by longitudinal variations in the donor web tension during printing. Accurate color registration is not achievable when printing along the length of the web does not begin at the same point for each color frame. For good color registration, printing should begin at the same point on the receiver for each color frame so that each color frame exactly and precisely overlaps the previous color frame. To make a color print, color frames or patches of yellow, magenta and cyan are typically used and applied one on the other on the dye receiver. The color frames exist on the donor web in ordered fashion and are detected by a sensor.

During the color thermal printing process, it is necessary to have the dye donor web properly positioned relative to the dye receiver to ensure full coverage of the image area by successive color patches. This need has been met by placing color discriminating optical sensors directly in the donor path just past the thermal print head in the direction of travel of the donor web as illustrated in U.S. Pat. No. 4,710,781 which issued Dec. 1, 1987 to S. W. Stephenson. These sensors detect the presence of the different colored patches on the donor as they advance. When these sensors detect a new color frame during the printing cycle, the donor advance is stopped, properly positioning the donor relative to the receiver. It is desirable to position the sensors as close as possible to the thermal print line of the thermal print head because all donor that occupies that distance after positioning is not used and is therefore wasted. Unfortunately, the physical configuration of the print head and surrounding mechanisms limit the minimum distance that can be achieved. Accordingly, it will be appreciated that it would be highly desirable to have a thermal printer in which none of the dye donor is wasted by the inability to locate the sensor at the thermal print line.

Some thermal printers position the sensors at a specified distance upstream of the thermal head. As transitions in colors are sensed, the take up drive system advances the donor a predetermined distance to position the next color beneath the print line of the thermal print head. A problem with this positioning arrangement is that the precision of the positioning mechanism of the donor drive is affected by the diameter of the roll of accumulated expended donor which changes significantly from empty to full. Consequently, color frames at the end of the donor roll cannot be positioned as close to the print line as those at the beginning. Each frame must therefore be sufficiently large to accommodate this error, again causing valuable donor to be wasted. One solution to this problem is using encoders and software algorithms to measure the rotational speed of the supply spool while printing and to provide a compensated take up rate. Unfortunately, such a solution is expensive, and still has an unattractively high positioning tolerance. Accordingly, it will be appreciated that it would be highly desirable to precisely position the color frames without using encoders or other complicated or expensive components.

SUMMARY OF THE INVENTION

The present invention is directed to overcoming one or more of the problems set forth above. Briefly summarized, according to one aspect of the present invention, a thermal printing apparatus comprises a rotatably mounted supply spool having thereon a dye bearing donor web containing a plurality of frames of dye, and a rotatably driven print drum for unwinding the web from the supply spool and advancing the web past a thermal print head at a print zone where dye is transferred to a print receiving medium by the print head. The print drum causes the supply spool to rotate as it unwinds web therefrom and further causes the web to be paid out of the print zone at a constant rate during printing. A rotatably mounted take-up spool accumulates web paid out of the print zone. A capstan roller is interposed between the print drum and the take-up spool and drivingly engages the donor web and driven by a stepper motor, controllably advances, at a known rate, the donor web towards the take-up spool as the web is paid out of the print zone. A single sensor which is sensitive to only the first of the color frames is positioned between the print drum and the supply spool to detect the starting point of the plurality of frames of dye, as the donor web advances. The distance along the donor between the print line and the sensor is translated into a precisely known number of steps of the capstan drive motor. Each frame length is translated into a number of steps of the capstan drive motor. This allows that once the start of the plurality of color frames is sensed it is possible to position it and the beginning of subsequent patches near to the heat line of the thermal head by energizing the motor for the proper number of steps.

According to another aspect of the present invention, a method for producing thermal prints comprises the steps of unwinding a dye bearing donor web having a plurality of frames of dye from a rotating supply spool and advancing the donor web to a print zone at which the web is acted upon by a thermal print head and print drum to transfer dye from the web to a receiving medium one frame at a time. The method includes advancing the donor web from the print zone toward a take-up spool by rotating the print drum by a motor means, winding up the advanced donor web on the take-up spool by rotatably driving the take-up spool by the motor means, positioning a sensor between the print drum and the supply spool and detecting a beginning of the first of the plurality of color frames as said donor web advances and producing a position signal, interposing a capstan roller between the print drum and the take-up spool, and drivingly engaging the donor web and controllably advancing the donor web with the capstan roller at a known rate and aligning the frames of dye, one at a time, with the receiver in the print zone in response to receiving the position signal.

The method may include the step of advancing the web with the capstan roller at a slower rate than the web is paid out of the print zone, or may include delaying operation of the capstan roller and advancing the web with the capstan roller at the same rate as the web is paid out of the print zone.

These and other aspects, objects, features and advantages of the present invention will be more clearly understood and appreciated from a review of the following detailed description of the preferred embodiment and appended claims, and by reference to the accompanying drawing.

BRIEF DESCRIPTION OF THE DRAWING

The drawing is a diagrammatical longitudinal cross-sectional view of a preferred embodiment of a thermal printer illustrating dye donor web drive components including a capstan drive and a single sensor positioned in accordance with the present invention.

DETAILED DESCRIPTION OF THE PREFERRED EMBODIMENTS

Referring to the drawing, a thermal printer 10 has a donor supply spool 12 supporting a dye bearing donor web 14. The supply spool 12 is rotatably mounted in the printer 10 and rotates as the donor web 14 is unwound. A slip clutch (not shown) prevents free-wheeling on the donor supply spool 12 so that the donor web 14 is unwound in a controlled manner.

Printing occurs at a printing section of the printer 10 wherein a thermal printing head 16 presses the dye donor web 14 and a dye receiving member against a print drum 18 for transferring dye from the donor 14 to the receiver. The print head 16 is movable between a printing position and a nonprinting position. At the printing position, the print head 16 presses the donor 14 and receiver against the drum 18 for printing, and, at the nonprinting position, the thermal head 16 is spaced from the print drum 18 so that it does not interfere with the travel of the web 14. The contact area of the drum 18 with the print head 16 through the media 14 is called the nip or print zone. Dye donor 14 entering the print zone passes over a guide roller 20, and passes over another guide roller 22 as it exits the print zone. The guiding roller 20 serves to hold the donor 14 away from the print head 16 in the nonprinting position while the guide roller 22 holds the donor 14 away from the print drum 18 as the web 14 exits the print zone.

The print drum 18 is rotatably driven by a motor, such as stepper motor 24, for example. The drum 18 may be directly driven by the stepper motor (not shown) or may be driven by means of gears or a belt, depending on the space allocation of the thermal printer 10. The driven print drum 18 unwinds donor 14 from the supply spool 12, and advances the web 14 past the print head 16 in the print zone where dye transfer occurs. Because the rate of travel of the web 14 is constant in the print zone during printing, the rotatably driven print drum 18 causes the supply spool 12 to rotate as it unwinds web 14 therefrom and further causes the web 14 to be paid out of the print zone at a constant rate.

The donor 14 exiting the print zone is taken up by a donor web take-up spool 28. The take-up spool 28 is rotatably mounted and is rotatably driven by a friction drive wheel 30. The drive wheel 30 is driven by a timing wheel 32 that can be driven by the timing belt 26 or gears, which, in turn, is driven by the stepper motor 24.

A driven capstan roller 34 is provided that has a cooperating idler roller 36 to receive the web 14 paid out of the print zone before the web 14 is taken up by the take-up spool 28. The capstan roller 34 is precisely driven by a capstan roller controller 38 which may be stepper motor with an electronic control to precisely step the motor and determine when the motor is to step the roller 34.

Operation of the present invention is believed to be apparent from the foregoing description, but a few words will be added for emphasis. As printing occurs in the print zone, the print drum 18 advances the donor 14 at a controlled constant rate for uniform printing. Because printing at the print zone occurs at a constant rate, the used donor 14 is paid out of the print zone at a constant rate also. Spent donor 14 is metered by the capstan roller 34 and taken up by the take-up spool 28. The donor web positioning system uses a single sensor 40 in conjunction with a capstan roller 34. The roller is driven by a stepper motor to precisely meter the donor web 14. The roller is positioned between the print drum 18 and the take-up spool 28 and drivingly engages the donor web and controllably advances the donor web towards the take-up spool 28 at a known rate as the web is paid out of the print zone. The single sensor 40 is positioned between the print drum 18 and the supply spool 12 to detect the start of the plurality of frames of dye, as the donor web 14 advances.

The present invention minimizes the amount of donor wasted and simplifies positioning of the individual color patches. This is accomplished by the independently powered capstan roller 34 that is positioned in the donor path between the print drum 18 and take up spool 28, and a single donor sensor 40 that is positioned between the print drum 18 and supply spool 12. The donor 14 is advanced at a rate that is always known and carefully controlled regardless of either of the spool diameters. This is accomplished by the capstan roller 34 that advances the web 14 without slipping and that is driven by a stepper motor to provide precise positioning. In addition, the distance along the donor path between the print line and the sensor 40 is precisely known and can be directly translated into a specific number of motor steps of the drive motor. Similarly, each individual patch length can be translated into a specific number of motor steps. Once the color transition which identifies the start of a print sequence has interrupted the sensor 40, the positioning of the first color patch at the print line, as well as successive positioning of the remaining color patches, can be done simply by energizing the drive motor for the required number of steps for each stage. This is an easy task for the capstan roller controller 38.

It can now be appreciated that there has been presented an apparatus and method for high precision donor web positioning in a thermal printer. The thermal printer has a capstan roller working in conjunction with a single sensor to achieve precise color registration.

The apparatus includes a rotatably mounted supply spool having thereon a dye bearing donor web containing a plurality of frames of dye, and a rotatably driven print drum for unwinding the web from the supply spool and advancing the web past a thermal print head at a print zone where dye is transferred to a print receiving medium by the print head. The print drum causes the supply spool to rotate as it unwinds web therefrom and further causes the web to be paid out of the print zone at a constant rate during printing. A rotatably mounted take-up spool accumulates web paid out of the print zone. A capstan roller is interposed between the print drum and the take-up spool and drivingly engages the donor web and controllably advances, at a known rate, the donor web towards the take-up spool as the web is paid out of the print zone. A single sensor is positioned between the print drum and the supply spool to detect the start of the plurality of frames of dye, as the donor web advances. The distance along the donor between the print line and the sensor is translated into a precisely known number of steps of the capstan drive motor. Each frame length is translated into a number of steps of the capstan drive motor.

With the present invention, none of the dye donor is wasted by the inability to locate the sensor at the thermal print line. A benefit of the present invention is that print quality is not influenced by the diameter of the take-up spool as the diameter of the spool changes during printing. As a result, color frames can be precisely positioned without using encoders or other complicated or expensive components.

It can also be appreciated that there has been presented a method for producing thermal prints which comprises the steps of unwinding a dye bearing donor web having a plurality of frames of dye from a rotating supply spool and advancing the donor web to a print zone at which the web is acted upon by a thermal print head and print drum to transfer dye from the web to a receiving medium one frame at a time. The method includes advancing the donor web from the print zone toward a take-up spool by rotating the print drum by a motor means, winding up the advanced donor web on the take-up spool by rotatably driving the take-up spool by the motor means, positioning a sensor between the print drum and the supply spool and detecting the start of the plurality of color frames as said donor web advances and producing a position signal, interposing a capstan roller between the print drum and the take-up spool, and drivingly engaging the donor web and controllably advancing the donor web with the capstan roller at a known rate and aligning the frames of dye, one at a time, with the receiver in the print zone in response to receiving the position signal. The method may include the step of advancing the web with the capstan roller at a slower rate than the web is paid out of the print zone. The method may also include delaying operation of the capstan roller and advancing the web with the capstan roller at the same rate as the web is paid out of the print zone.

While the invention has been described with particular reference to a preferred embodiment, it will be understood by those skilled in the art that various changes may be made and equivalents may be substituted for elements of the preferred embodiment without departing from invention. For example, while a stepper motor and capstan controller are preferred, another precisely controllable motor may be used, such as a DC motor with an inexpensive encoder, for example. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A thermal printing apparatus comprising:

a supply spool having thereon a dye bearing donor web containing a plurality of frames of dye, each of said frames having a frame length;

means for rotatably supporting said supply spool;

a rotatably driven print drum for unwinding said web from said supply spool and for advancing said web past a thermal print head at a print line in a print zone where dye is transferred to a print receiving medium by said print head, said rotatably driven print drum causing said supply spool to rotate as it unwinds web therefrom and further causing the web to be paid out of the print zone at a constant rate during printing;

a rotatably mounted take-up spool for accumulating web paid out of said print zone;

motor means for rotatably driving said print drum and said take-up spool and causing said take-up spool to tension said web;

a capstan roller interposed between said print drum and said take-up spool and drivingly engaging said donor web and controllably advancing said donor web towards said take-up spool as said web is paid out of said print zone, said capstan roller advancing said web at a known rate;

means for driving said capstan roller; and a single sensor positioned between said print drum and said supply spool to sense start of said plurality of frames of dye as said donor web advances.

2. A thermal printing apparatus, as set forth in claim 1, including means for translating distance along the donor web between the print line and the sensor to a precisely known number of steps of the capstan roller.

3. A thermal printing apparatus, as set forth in claim 1, including means for translating each said frame length into a number of steps of said capstan roller.

* * * * *